US006006683A

United States Patent [19]

Janka et al.

[11] Patent Number: 6,006,683

[45] Date of Patent: Dec. 28, 1999

[54] METHOD AND ARRANGEMENT FOR SUPPLYING AIR TO RECOVERY BOILER

[75] Inventors: Kauko Janka; Matti Ylitalo; Tuomo Ruohola, all of Tampere, Finland

[73] Assignee: Kvaerner Pulping Oy, Tampere, Finland

[21] Appl. No.: 09/017,890

[22] Filed: Feb. 3, 1998

[30] Foreign Application Priority Data

Feb. 7, 1997 [FI] Finland ..... 970539

[51] Int. Cl.[6] ..... F23G 7/04; F23B 7/00

[52] U.S. Cl. ..... 110/348; 110/238; 110/244; 110/297; 110/345; 110/234; 431/2

[58] Field of Search ..... 110/238, 348, 110/243, 244, 245, 251, 297, 345, 346, 234; 431/2, 7, 8, 9, 10

[56] References Cited

U.S. PATENT DOCUMENTS

| | | | |
|---|---|---|---|
| 3,215,099 | 11/1965 | Coulter, Jr. | 110/238 |
| 3,413,936 | 12/1968 | Matthews | 110/238 |
| 4,014,296 | 3/1977 | Astrom . | |
| 4,389,979 | 6/1983 | Saxlund | 110/244 X |
| 5,007,354 | 4/1991 | Uppstu | 110/238 |
| 5,205,227 | 4/1993 | Khinkis et al. | 110/345 |
| 5,341,753 | 8/1994 | Russell | 122/4 D |
| 5,450,803 | 9/1995 | Svensk et al. | 110/346 |
| 5,771,817 | 6/1998 | Olausson et al. | 110/238 |

FOREIGN PATENT DOCUMENTS

| | | |
|---|---|---|
| 934123 | 9/1993 | Finland . |
| 3125429A1 | 2/1983 | Germany . |
| WO94/12829 | 11/1993 | WIPO . |
| WO95/35409 | 5/1995 | WIPO . |

OTHER PUBLICATIONS

"The Chemical Recovery Boiler Optimized Air System", from Tappi Notes, Jan. 10–15, 1988.

*Primary Examiner*—Ira S. Lazarus
*Assistant Examiner*—Ljiljana V. Ciric
*Attorney, Agent, or Firm*—Rockey, Milnamow & Katz, Ltd.

[57] ABSTRACT

A method and an arrangement for supplying air to a recovery boiler. In the method, the air is supplied to the recovery boiler at at least one air supply level so that four vortices are formed therein, the vortices spinning, in pairs, in opposite directions to one another so that any two adjacent vortices always spin in opposite directions to one another. The arrangement comprises nozzles that are arranged to blow air so that four vortices are formed in the recovery boiler, any two adjacent vortices always spinning in opposite directions to one another.

19 Claims, 3 Drawing Sheets

METHOD AND ARRANGEMENT FOR SUPPLYING AIR TO RECOVERY BOILER

BACKGROUND OF THE INVENTION

The invention relates to a method of supplying air to a recovery boiler, in which method the air needed for combustion is supplied to the recovery boiler at various levels of the recovery boiler in the vertical direction, at at least one air supply level the air being supplied to the recovery boiler in such a way that a vortex spiralling around the vertical axis is formed in the recovery boiler.

The invention also relates to an arrangement for supplying air to a recovery boiler, the arrangement comprising air nozzles at various levels of the recovery boiler in the vertical direction, the nozzles at at least one air supply level being arranged to supply air to the recovery boiler in such a way that a vortex spiralling around the vertical axis is formed in the recovery boiler.

In recovery boilers, various ways of supplying air are used, so that black liquor would burn as efficiently as possible and yet the combustion process could be controlled in a desired manner in both the horizontal and the vertical directions of the boiler. Typically, air is supplied at various levels in the vertical direction of the recovery boiler so as to cause sub-stoichiometric combustion in the gas flow direction as far as possible, i.e. in the vertical direction of the recovery boiler. The final air causing stoichiometric combustion is not fed until the final, typically tertiary step. Solutions like this are known, for example, from U.S. Pat. No. 5,007,354.

A problem in the above solution is that to make the combustion efficient, the droplets of fuel should be as small as possible so that the fuel and the combustion air would mix as thoroughly as possible. As a result of this, however, the particulate fuel droplets tend to move with the gas flow to the upper parts of the furnace before burning, which defers the combustion step too much, and so the combustion is no longer efficient and the emissions are not reduced efficiently. With regard to the emissions, it would be advantageous if the combustion were sub-stoichiometric as far as possible, so that essentially no $No_x$ compounds would be formed. As the thermal value is also low, the combustion is not so efficient. Also, the fact that the droplets move up with the gas flow and do not burn until after this may make the temperature close to the superheaters rise too high, which speeds the corrosion of the superheaters and thereby shortens their effective life.

A solution suggested to the problem in Finnish Patent Application No. 931,123 is that the nozzles are not placed in horizontal supply layers but in a plural number of arrays of nozzles on top of one another so as to make the air supply more efficient with respect to burning. The solution, however, does not solve the problem in essence. The structure presented in the application is difficult to build, and the variations in the air distribution in the vertical direction that are required by the combustion process are difficult to accomplish.

In all the solutions, problems are posed by the channelling of the flows in the upper part of the furnace and by different vertical backflows, whereby the volume of the furnace is not actually used efficiently with respect to the reactions, and so the walls cannot be used efficiently for heat transfer.

U.S. Pat. No. 5,450,803 teaches a solution in which secondary air is supplied to a recovery boiler before a black liquor supply point so as to make the secondary air spin. This forms a vertical vortex in the recovery boiler. A problem in the solution is that by the effect of the centrifugal force generated by the vortex, droplets of black liquor assemble on the walls of the furnace, blocking, for example, nozzle apertures. It has also been noted that as a result of this, a hole tends to form in the middle of the bed of the recovery boiler, which increases the stress that the bottom of the recovery boiler is subjected to. Further, as the spinning motion of the flue gases caused by the vortex tends to last, this also causes distortion of the flow at the superheaters, which both weakens the operation of the superheaters and causes exceptional accumulation of deposit in them.

In the lecture "The Chemical Recovery Boiler Optimized Air System" by Lefebvre Burell, given in TAPPI Kraft Recovery Operations Seminar in Orlando on 10th to 15th of Jan. 1988, a solution was proposed in which tertiary air was supplied by making the air jets cross so that a vortex was formed in the middle of the recovery boiler. In this solution, the problem is that in addition to the vortex desired, separate uncontrolled local vortices were formed, and these made further droplets accumulate on the walls of the recovery boiler. Further, spinning performed at the tertiary level did not bring about the expected advantages in the action and combustion of the black liquor droplets: for example, the advantages brought about by quicker drying of the black liquor droplets were not achieved.

BRIEF SUMMARY OF THE INVENTION

The object of the present invention is to provide a method and an arrangement by which air can be supplied to the recovery boiler efficiently, and advantageously and reliably with respect to the combustion and the other operation of the boiler, simultaneously avoiding the problems of the earlier solutions. The method of the invention is characterized in that the air supply is arranged such that four vortices are formed at the air supply level concerned, the vortices spinning, in pairs, in opposite directions, so that the adjacent vortices always spin in opposite directions; and that to form the vortices, air is supplied from at least two opposite walls of the recovery boiler so that the air jets flow in the spinning directions of at least two vortices spinning in opposite directions, at least primarily parallel to the tangents of the vortices.

The arrangement of the invention is characterized by comprising nozzles at at least one air supply level, the nozzles being directed to blow air so that four vortices spinning, in pairs, in opposite directions are formed in the recovery boiler, the adjacent vortices always spinning in opposite directions.

The essential idea of the invention is that air is supplied to the recovery boiler at at least one air supply level so that four vortices are formed at the same level, two of the vortices spinning in one direction and two in the other direction. This can be achieved in many different ways: the essential point is that the air jets are injected primarily in the spinning direction of a vortex, parallel to the tangent of the vortex, thereby forming vortices and strengthening the existing vortices. The simplest way of achieving this is to supply air to the recovery boiler from two opposite walls by air jets arranged in the middle of the walls and, in addition to these jets, to supply air from the corners of the two other opposite walls of the boiler directly toward each other.

In this way four vortices are formed, in which the air flow directions at the points where the spinning vortices touch one another are the same. The vortices are then easy to control, and they can be either strengthened or allowed to weaken in the vertical direction of the recovery boiler in a desired manner.

The advantage of the invention is that when four vortices, instead of one, are formed at the air supply level, the diameters of the vortices are essentially smaller than in the case of one vortex. The catapulting of the droplets onto the walls of the recovery boiler, caused by the four vortices, is less extensive than in the case of one vortex, since the centrifugal force at the same angular speed is smaller. Further, the dead areas at the corners of the recovery boiler are smaller than in the case of larger vortices, and so the air and the black liquor droplets mix more efficiently. Further, since the vortices at the nose arch of the upper part of the recovery boiler can be made to mix with one another and, when tertiary air is supplied, even substantially eliminated, the flow will not be distorted in the superheater area. The combustion and the mixing of the combustion air and the black liquor droplets can thus be made to take place in the recovery boiler in a desired manner both in respect of the cross-section and in the vertical direction, and the black liquor droplets can be made to dry and thereby burn efficiently in the lower part of the recovery boiler.

Another essential advantage of the invention is that to form vortices, the air jets are not required to have deep penetration. The reason is that the four formed vortices as such cause mixing, and that the essential point for the formation of the vortices is that the momentum of the air jets transfers to the spinning motion to be achieved. To achieve this, shallow penetration is sufficient.

BRIEF DESCRIPTION OF THE DRAWINGS

The invention will be described in greater detail in the attached drawings, in which.

DETAILED DESCRIPTION OF THE INVENTION

Figure 1:
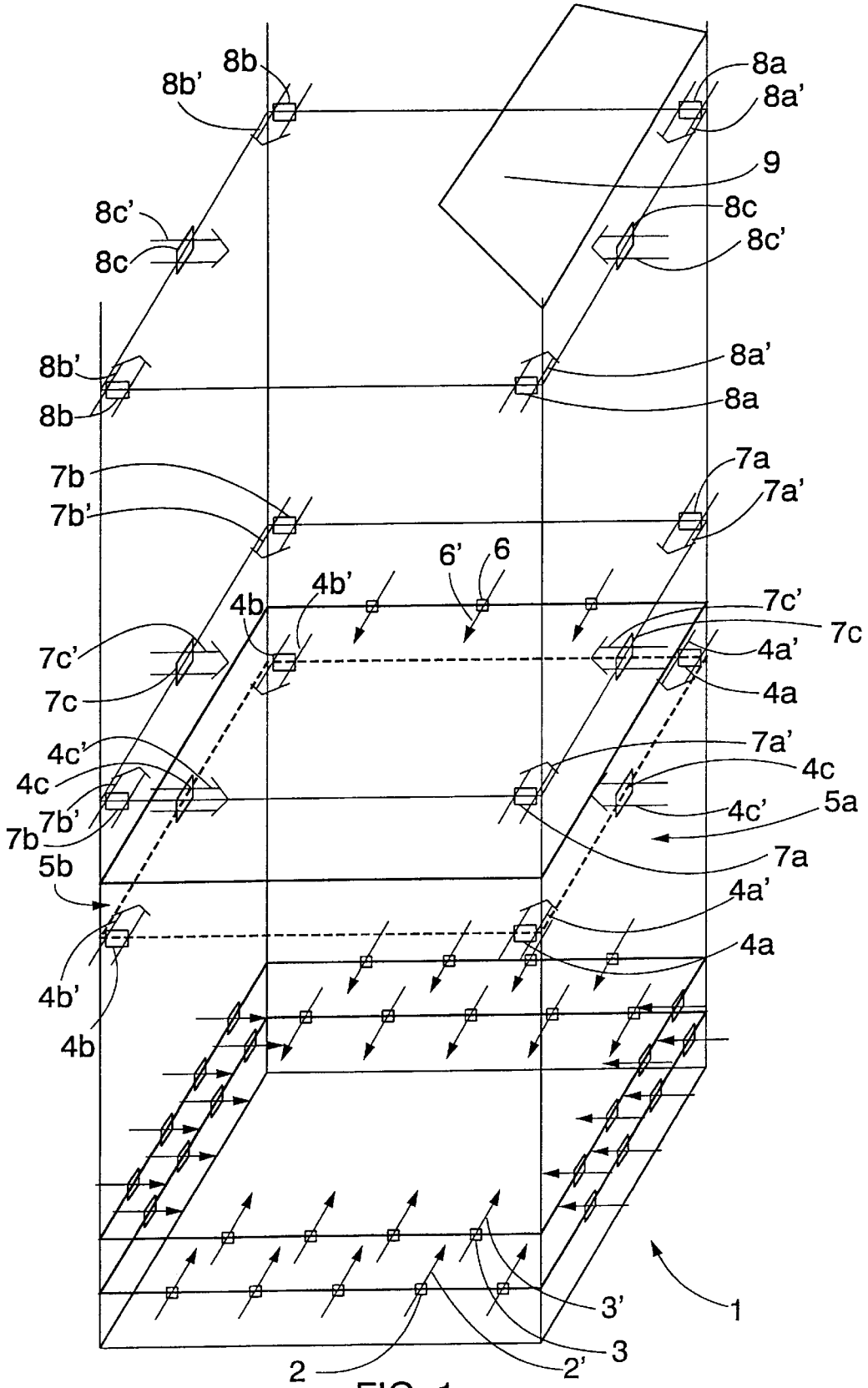
FIG. 1 is a schematic view of an embodiment of the invention for supplying air to a recovery boiler.

FIG. 1 is a schematic perspective view of a part of a furnace in a recovery boiler. Primary air is supplied to the lower part of a recovery boiler 1 from several nozzles 2 located on all walls of the recovery boiler in the manner indicated by arrows 2'. Correspondingly, so-called sub-secondary air is supplied above the primary air from nozzles 3 located on all the walls in the manner indicated by arrows 3'. Both the primary air and the sub-secondary air are here supplied evenly from all sides of the recovery boiler so that essentially no vortical air flow is formed. Above the sub-secondary air, super-secondary air is supplied from nozzles 4*a* to 4*c* in the manner indicated by arrows 4*a'* to 4*c'*. Arrows 4*a'* here indicate how jets of super-secondary air are injected toward each other from two corners of the recovery boiler parallel to a wall 5*a* between the corners. Arrows 4*b'*, in turn, indicate how jets of super-secondary air are injected toward each other at the other edge of the recovery boiler parallel to a second wall 5*b*. At both edges of the furnace of the recovery boiler, air is thus supplied from the corners, parallel to parallel walls of the recovery boiler toward the centre line of the boiler. As for arrows 4*c'*, they indicate how super-secondary air is supplied from the middle of walls 5*a* and 5*b* from between the air flows passing between arrows 4*a'* and 4*b'* toward the central axis of the recovery boiler. In this invention, this forms four separate vortices in the crosswise direction of the recovery boiler. The formation of the vortices is illustrated in greater detail in FIG. 2. The black liquor is injected to the recovery boiler from black liquor nozzles 6 in the manner indicated by arrows 6' from above the super-secondary air so that the black liquor droplets are efficiently mixed by the formed vortices with the air supplied, whereby the droplets dry quickly, burning in a rapid and controlled manner. The black liquor can be supplied to the recovery boiler from one or more sides of the recovery boiler.

Above the black liquor nozzles, tertiary air is supplied to the recovery boiler. The figures show that it is supplied in the same way as the super-secondary air from nozzles 7*a* to 7*c* in the manner indicated by arrows 7*a'* to 7*c'*. The supply of tertiary air thus supports the supply of super-secondary air and maintains the vortices and their distribution unchanged or, if necessary, enhances them. If desired, the tertiary air can be supplied from several dispersed nozzles in the same way as the primary and the sub-secondary air, but this weakens the vortical effect of the super-secondary air and may even stop the vortex.

Further, above the tertiary air, it is possible to supply still more air from nozzles 8*a* to 8*c* in the manner indicated by arrows 8*a'* to 8*c'* so as to effect the desired stoichiometric combustion. This supply of "super-tertiary" air takes place slightly below a nose arch 9, and the super-tertiary air can be supplied either by enhancing the vortical characteristic of the super-secondary air in the manner illustrated in FIG. 3, or by using separate nozzles on each wall in the same way as in the supply of primary and sub-secondary air.

After the final air supply step required by the stoichiometric combustion, the flue gases and the combustion material collide with the nose arch 9 of the recovery boiler, which makes the vortices mix and thereby enhances the final combustion step before the flue gases are free to flow to the superheaters arranged after the nose arch. Because of this, any distortion of the flow potentially caused by the vortices will not take place, and the flow from the nose arch to the superheaters is much smoother than what has been achieved with the vortical air supplies used earlier.

The advantage of the invention is that the centrifugal forces formed in the vortices with a smaller diameter cause less catapulting of the droplets of the black liquor to be burned onto the walls of the recovery boiler, and so less deposit adheres to the walls. Correspondingly, the droplets of black liquor mix rapidly with hot air and the flue and combustion gases, and they also dry more rapidly than before, from which it follows that the combustion starts earlier and has more time to be completed before the final air supply step.

Figure 2:
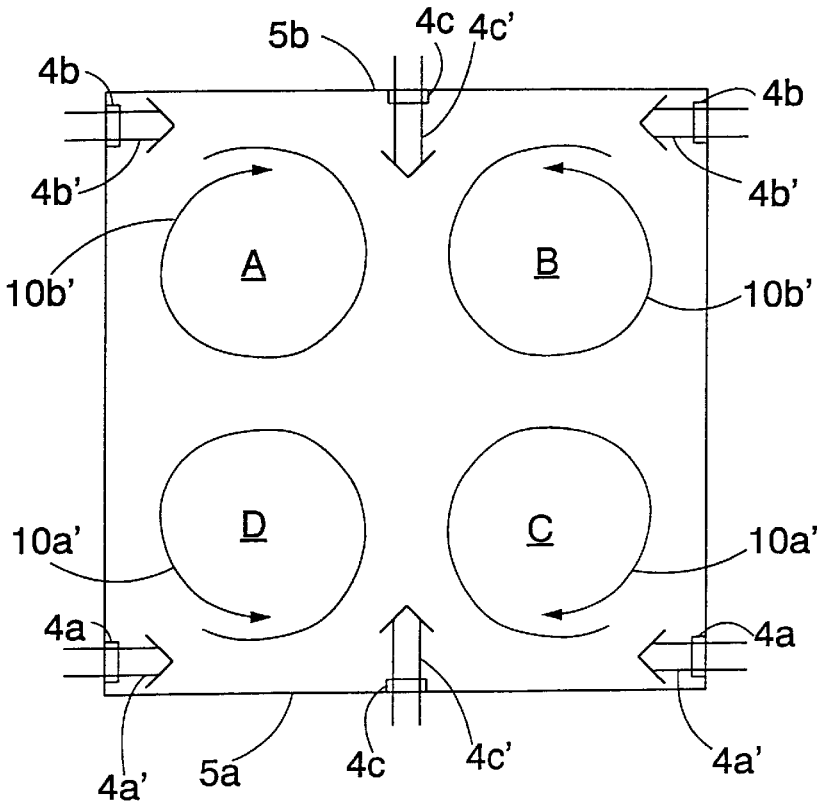
FIG. 2 is a schematic view showing how vortices are formed at one air supply level.

FIG. 2 is a schematic view illustrating how four small vortices instead of one large vortex can be formed in the furnace of the recovery boiler by using nozzles 4*a* to 4*c*, 7*a* to 7*c* and 8*a* to 8*c*, all of which appear from FIG. 1. FIG. 2 shows nozzles 4*a* to 4*c*, from which is injected air that subsequently flows along walls 5*a* and 5*b*. When the air flows coming from the nozzles collide, as indicated by arrows 4*a'*, with the air flow indicated by arrow 4*c'* directed from the middle of wall 5*a* toward the centre of the recovery boiler, then the air flows turn toward the centre of the recovery boiler, as indicated by arrows 10*a'*. Likewise, the opposite air flows indicated by arrows 4*b'* flow toward each other along wall 5*b*, until they collide with the air flow indicated by arrow 4*c'* passing from wall 5*b* toward the centre of the recovery boiler. The air flows indicated by arrows 4*b'* then turn in the manner indicated by arrows 10*b'* toward the centre of the recovery boiler. When air flows 4*c'* collide with air flows 10*a'* and 10*b'* in the middle of the recovery boiler, they turn from the centre of the recovery boiler toward the walls between walls 5*a* and 5*b,* since this is the only direction from which no air flow producing resistance is passing toward them. The air flows thus start to circulate and simultaneously rise, whereby four vortical flows A to D are formed upward from the supply point of super-secondary air in the recovery boiler. Since the directions of the air flows at the points where they touch are the same, they do not weaken or disturb each other, and so the air flow rises upward in a vortical manner and is strengthened, if necessary, by the supply of tertiary and super-tertiary air, if their supply is implemented in the manner shown in FIG. 1.

Figure 3A:
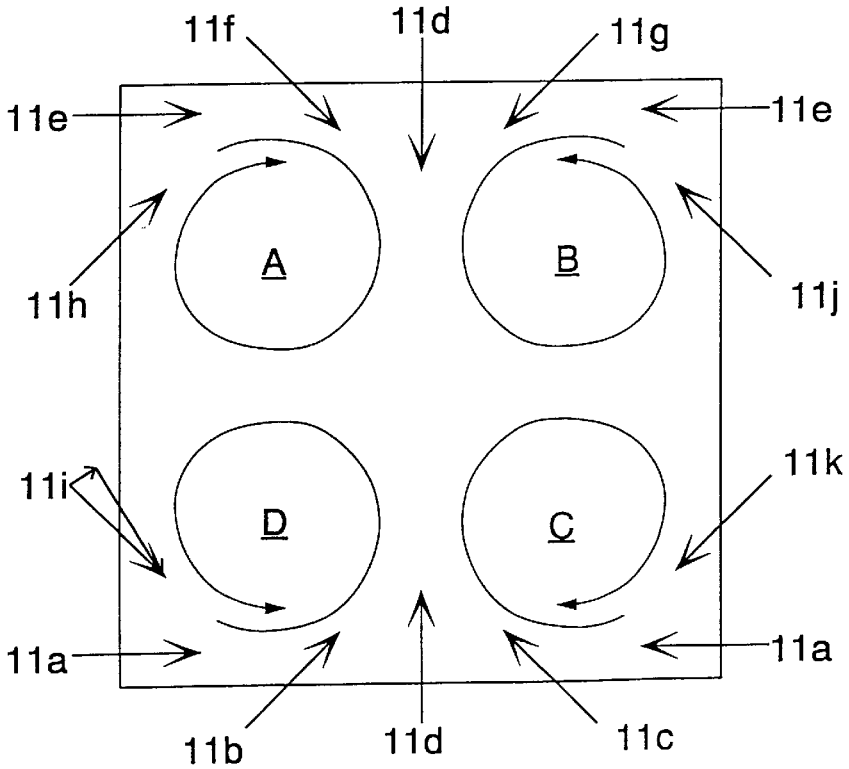
FIGS. 3*a* to 3*c* show alternative ways of supplying air to a furnace so as to form vortices.
Figure 3B:
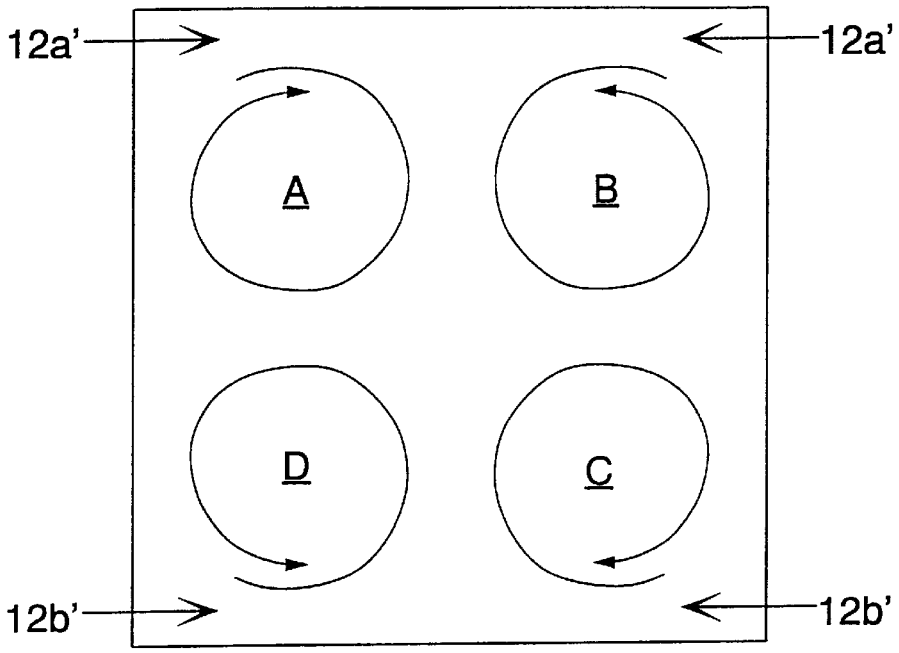
Figure 3C:
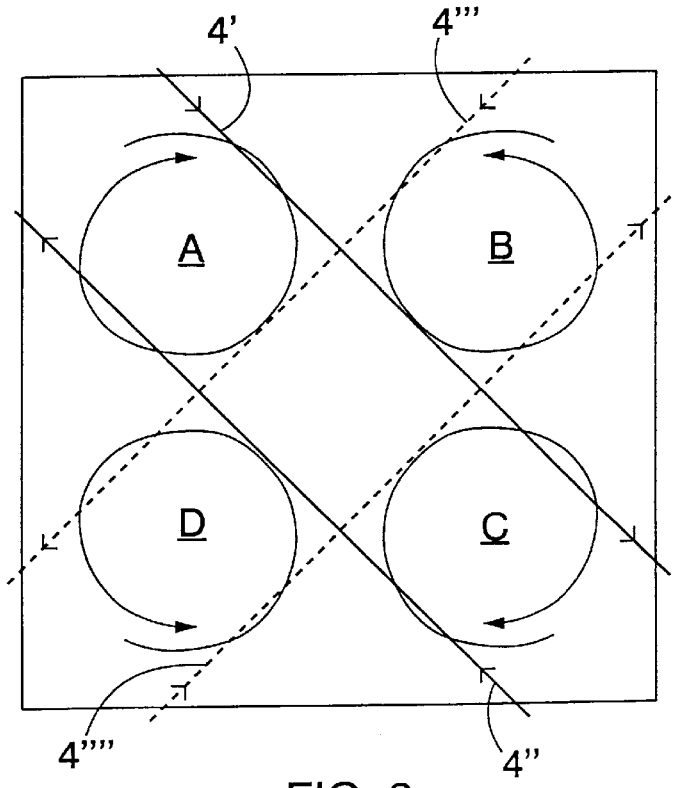

FIG. 3*a* shows how air jets 11*a* to 11*k* can be directed in different ways from different directions to form vortices A to D. As shown in the figure, all air jets are directed so that their flow direction is mostly parallel to the circumference of one or more vortices or so that when the air flow direction of the vortex is divided into a component tangential to the circumference of the vortex and a component perpendicular to it, the tangential component is essentially larger than the perpendicular component. FIG. 3*b,* in turn, shows an embodiment in which vortices A to D are formed entirely by means of air flows 12*a',* 12*b'* coming from opposite walls: the air flows collide in the middle of the walls adjacent to these walls, thereby forming vortices. FIG. 3*c,* in turn, shows how vortices A to D are formed by air flows that are diagonal to the furnace of the recovery boiler, whereby there are two pairs of air flows at essentially the same air supply level but at slightly different heights so that the pairs of air flows cross each other but do not collide. In this embodiment, the air flows in one pair of air flows pass in opposite directions, touching three vortices and thereby strengthening their spinning motion. For example, the air flow indicated by arrow 4' touches vortices A, B and C, and the air flow indicated by arrow 4" touches vortices C, D and A in the opposite direction. Likewise, the air flows indicated by arrows 4'" and 4"" touch vortices B, A and D, and vortices D, C and B, respectively, thereby strengthening their spinning motion.

In all embodiments, with the exception of the embodiment of FIG. 3*c,* it is possible to use air jets with relatively shallow penetration, since the actual mixing in the furnace is effected by vortices and so air jets with deep penetration are not needed to effect mixing.

In the above description and the drawings, the invention is presented only by way of an example, and the invention is not to be construed as being limited by them. The invention can be applied to all kinds of air supply solutions designed for a recovery boiler in which air is supplied from more than one successive levels in the vertical direction of the recovery boiler. The essential feature is that at at least one air supply level air is supplied so that four vortices spinning in synchronization with one another are formed, the vortices causing efficient mixing of the droplets of black liquor and the combustion air so that the combustion is efficient and that the recovery boiler is fouled as little as possible. Air can also be supplied by using normal supplies of primary, secondary and tertiary air, and the secondary or the tertiary air need not be divided into two parts in the manner indicated in FIG. 1. The nozzles can be arranged in many different ways in the recovery boiler, as long as the effect of the incoming air flows on the formation of the vortices is of the type desired. The nozzles and thereby the air jets injected from the nozzles can be grouped in vertical, horizontal or diagonal arrays, or they can be grouped in patterns of different shapes on a wall of the recovery boiler, for example in the shape of a square, a rhombus or the like. The most important feature is that the air jets are such that they strengthen the desired effect and do not extend so far that they would affect a vortex whose spinning direction at the point where the air jet and the vortex meet is opposite to the direction of the air jet. Further, since in most embodiments the jets are not required to have deep penetration, air jets with various shapes can be used, even jets that differ notably from the commonly used air jets with respect to the shape. For example, an elongated structurally advantageous slit that is parallel to the wall pipes is useful and easy to implement in accordance with the basic idea of the invention. The cross-section of the air nozzles can also differ from the common cross-section, i.e. typically a round or a rounded cross-section. Another advantage of the invention is thus that the air jets can be placed in various ways and that they can be very different in shape, and that the invention enables solutions that are advantageous to both the structure of the boiler and to the implementation of different air distribution systems required by the combustion conditions. Also, the invention can be easily applied to old boilers: the existing air openings can be used so that completely new air openings are either not needed at all or, at most, a very small number of such openings are needed. The nozzle mentioned in the embodiment presented in the application can be a single nozzle, or a group of nozzles comprising two or more nozzles, the group of nozzles being arranged to operate in accordance with the basic idea of the invention.

We claim:

1. A method of supplying air to a recovery boiler having a first pair of opposite walls and a second pair of opposite walls, in which method the air needed for combustion is supplied to the recovery boiler at various levels of the recovery boiler at at least one air supply level the air being supplied to the recovery boiler in such a way that four vortices spiralling around corresponding vertical axes are formed at said at least one air supply level, said vortices spinning, in pairs, in opposite directions to one another so that any two adjacent vortices always spin in opposite directions to one another and so that, to form said vortices, air is supplied from at least said first pair of opposite walls of the recovery boiler so that the supplied air flows in each of the spinning directions of said vortices spinning in opposite directions.

2. A method according to claim 1, wherein the air is supplied at at least one air supply level below a black liquor supply level of the recovery boiler so that vortices are formed.

3. A method according to claim 1 or 2, wherein the air is supplied at all the air supply levels that are above the air supply level that is immediately below the black liquor supply level so that vortices are formed.

4. A method according to claim 1 or 2, wherein, to form vortices, air is supplied at a given at least one air supply level from the middle of said first pair of opposite walls in a direction substantially toward the center of the recovery boiler.

5. A method according to claim 1 or 2, wherein, to form, vortices, air is supplied at a given at least one air supply level from each of two edges of each of said second pair of opposite walls and in opposite directions to one another.

6. A method according to claim 1 or 2, wherein the air is supplied at at least one level above a black liquor supply level of the recovery boiler so that vortices are formed.

7. A method according to claim 6, wherein the air is supplied at all the air supply levels that are above the air supply level that is immediately below the black liquor supply so that vortices are formed.

8. A method according to claim 3, wherein, to form vortices, air is supplied at a given air supply level from the middle of said first pair of opposite walls, in a direction substantially toward the center of the recovery boiler.

9. A method according to claim 6, wherein, to form vortices, air is supplied at a given air supply level from each of two edges of said second air of opposite walls, in a direction parallel to said first pair of opposite walls and in opposite directions.

10. An arrangement for supplying air to a recovery boiler having walls, said walls being a first pair of opposite walls and a second pair of opposite walls, the arrangement comprising air nozzles at various levels of the recovery boiler, the nozzles at at least one air supply level being arranged to supply air to the recovery boiler in such a way that four vortices spinning, in pairs, in opposite directions to one another at said at least one level are formed in the recovery boiler, any two adjacent vortices always spinning in opposite directions to one another.

11. An arrangement according to claim 10, wherein the nozzles are arranged at at least one air supply level below a black liquor supply level of the recovery boiler.

12. An arrangement according to claim 10 or 11, wherein, to form vortices, the nozzles are arranged at all the air supply levels from a level immediately below a black liquor supply level to the highest air supply level.

13. An arrangement according to claim 10 or 11, wherein at at least one air supply level there are nozzles in the middle of said first pair of opposite walls, the nozzles being arranged to blow air from the middle of said walls in a direction substantially toward the center of the recovery boiler.

14. An arrangement according to claim 10 or 11 comprising nozzles at each of two edges of said second pair of opposite walls at at least one air supply level, the nozzles being directed to inject air jets toward each other in a direction substantially parallel to said first pair of opposite walls.

15. An arrangement according to claim 10 or 11 further comprising, at the same air supply level, two air jets arranged to blow in opposite directions to each other and diagonally to the walls of the recovery boiler, and also comprising substantially perpendicularly to these air jets, two more air jets arranged to blow in opposite directions to each other so that said air jets do not collide with each other, whereby each air jet is directed so as to to touch three of the vortices formed in the recovery boiler.

16. An arrangement according to claim 10 or 11, wherein the nozzles are arranged at at least one air supply level above a black liquor supply level of the recovery boiler.

17. An arrangement according to claim 16, wherein at at least one air supply level there are nozzles in the middle of said first pair of opposite walls, the nozzles being arranged to blow air from the middle of the walls in a direction substantially toward the center of the recovery boiler.

18. An arrangement according to claim 16 comprising nozzles at each of two edges of said second pair of opposite walls at at least one air supply level, the nozzles being directed to inject air toward each other in a direction parallel to said first pair of opposite walls.

19. An arrangement according to claim 16 further comprising, at the same air supply level, two air jets arranged to blow in opposite directions and diagonally to the walls of the recovery boiler, and, substantially perpendicularly to these air jets, two more air jets arranged to blow in opposite directions so that said air jets do not collide with each other, whereby each air jet is directed to touch three of the vortices formed in the furnace of the recovery boiler.

* * * * *